US010356882B2

(12) United States Patent
Dyal

(10) Patent No.: US 10,356,882 B2
(45) Date of Patent: Jul. 16, 2019

(54) METHODS, SYSTEMS, AND PRODUCTS FOR CONTROL OF ELECTRICAL LOADS

(71) Applicant: AT&T Intellectual Property I, L.P., Atlanta, GA (US)

(72) Inventor: John Tatum Dyal, Acworth, GA (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 766 days.

(21) Appl. No.: 14/473,281

(22) Filed: Aug. 29, 2014

(65) Prior Publication Data

US 2016/0062324 A1 Mar. 3, 2016

(51) Int. Cl.
*H05B 37/02* (2006.01)

(52) U.S. Cl.
CPC ..... *H05B 37/0272* (2013.01); *H05B 37/0245* (2013.01)

(58) Field of Classification Search
None
See application file for complete search history.

(56) References Cited

U.S. PATENT DOCUMENTS 5,463,286 A 10/1995 D'Aleo et al.
6,380,696 B1 4/2002 Sembhi et al.
7,566,995 B2 7/2009 Altonen et al.
7,683,755 B2 3/2010 Ostrovsky et al.
8,280,558 B2 10/2012 Picco
8,742,680 B2 6/2014 Cowburn
2005/0116667 A1* 6/2005 Mueller ..... E04F 13/08 315/312
2006/0076908 A1 4/2006 Morgan et al.
2007/0217404 A1* 9/2007 Kawamata ..... H05B 37/02 370/360
2008/0067959 A1* 3/2008 Black ..... H05B 37/0245 315/324
2008/0231464 A1* 9/2008 Lewis ..... H05B 37/0272 340/5.74
2009/0243509 A1 10/2009 Barnett et al.
2010/0141153 A1* 6/2010 Recker ..... H05B 33/0803 315/149
2010/0207532 A1 8/2010 Mans
2011/0122085 A1* 5/2011 Chang ..... G06F 1/1626 345/174
2012/0080944 A1* 4/2012 Recker ..... H02J 9/02 307/25
2012/0306405 A1* 12/2012 Kang ..... H05B 37/0272 315/292
2013/0271025 A1 10/2013 Horn
2013/0342131 A1* 12/2013 Recker ..... H05B 33/0842 315/292

(Continued)

OTHER PUBLICATIONS

Unknown, "7-Button Remote Model TC 318-7", Skylink Group, 2010, 4 pages.

(Continued)

*Primary Examiner* — Tuan C Dao
(74) *Attorney, Agent, or Firm* — Scott P. Zimmerman, PLLC

(57) ABSTRACT

A single input to a lighting system may control several different light fixtures. Multiple light fixtures may be connected to a switch or controller of the lighting system. A user makes an input to the lighting system, and individual light fixtures are activated as the user continues making the input.

18 Claims, 22 Drawing Sheets

(56) References Cited

U.S. PATENT DOCUMENTS

| | | | | |
|---|---|---|---|---|
| 2014/0062340 | A1 | 3/2014 | Elgayyar | |
| 2016/0205748 | A1 * | 7/2016 | Lashina | H05B 33/0851 315/130 |

OTHER PUBLICATIONS

Unknown, "LMLS-400/400-L Digital Lighting Management Closed Loop Single Zone Photosensor", WattStopper, Mar. 2012, 14 pages.

* cited by examiner

METHODS, SYSTEMS, AND PRODUCTS FOR CONTROL OF ELECTRICAL LOADS

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

BACKGROUND

Lighting control is stagnant. For decades, simple switches have controlled light fixtures. Occupants of homes and businesses must walk to different rooms to operate the lights. Custom lighting solutions do exist, but they are expensive and require custom wiring, programming, and dedicated input devices.

BRIEF DESCRIPTION OF THE SEVERAL VIEWS OF THE DRAWINGS

The features, aspects, and advantages of the exemplary embodiments are better understood when the following Detailed Description is read with reference to the accompanying drawings, wherein.

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
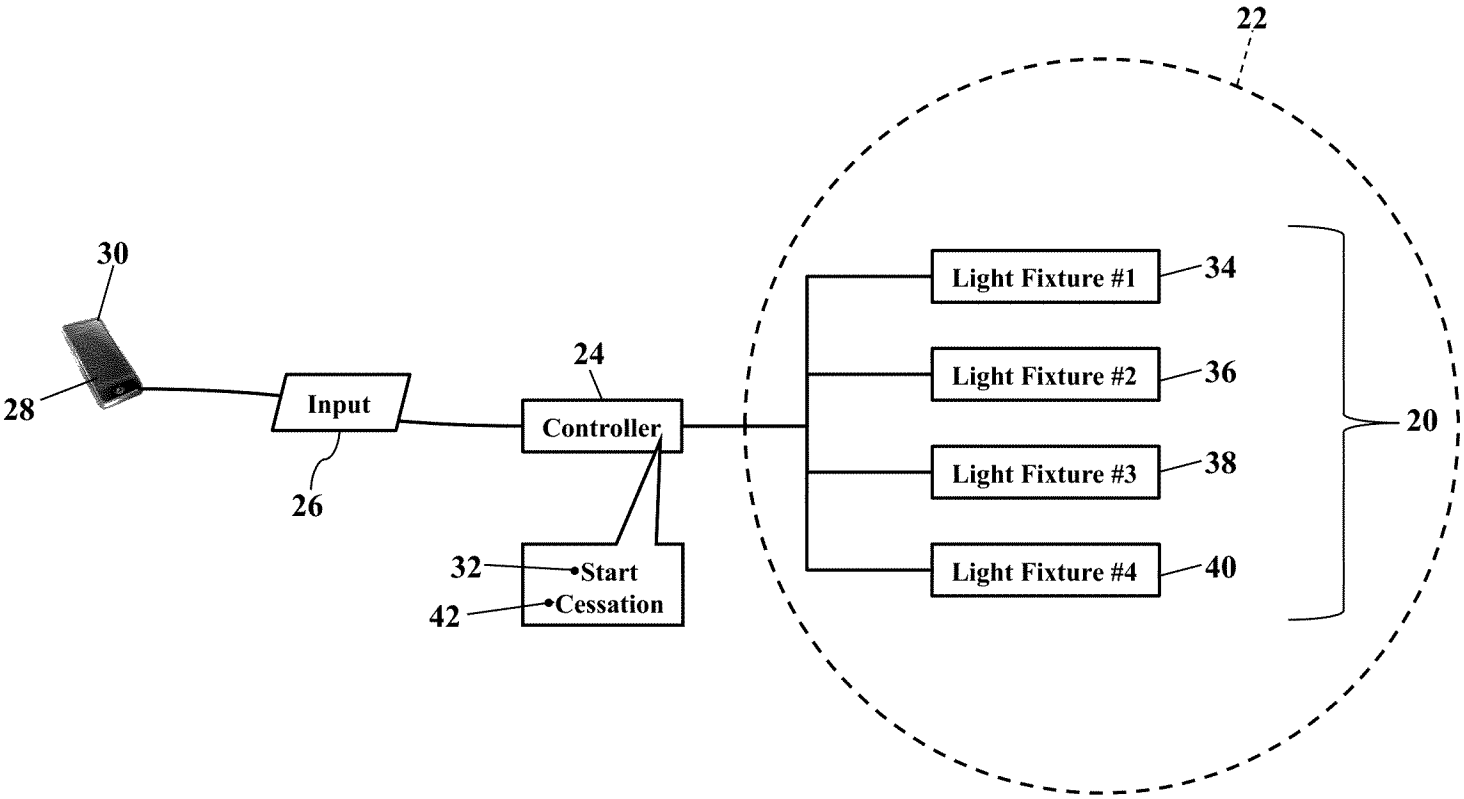
FIG. 1 is a simplified schematic illustrating an environment in which exemplary embodiments may be implemented.

FIG. 1 is a simplified schematic illustrating an environment in which exemplary embodiments may be implemented. FIG. 1 illustrates multiple light fixtures 20 illuminating a lighting environment 22. The lighting environment 22 may be a single room or multiple rooms of a home or building, as later paragraphs will explain. Regardless, a controller 24 activates the multiple light fixtures 20. The controller 24 responds to an input 26 from an input device 28. FIG. 1, for simplicity, illustrates the input device 28 as a user's smartphone 30. The input device 28, though, may be any other device or switch, as later paragraphs will also explain. Here, though, the input 26 sequentially activates the multiple light fixtures 20. That is, at a start 32 of the input 26, the controller 24 may initially activate a first light fixture 34. As the user continues making the input 26, the controller 24 may additionally activate a second light fixture 36. Continued receipt of the input 26 may cause the controller 24 to additionally activate a third light fixture 38. The controller 24 may sequentially activate more light fixtures (such as a fourth light fixture 40) as the user continues making the input 26. However, when the user ceases the input 26, the controller 24 receives or senses the cessation 42 and ceases activating additional light fixtures 20. Exemplary embodiments thus permit the user to make the single, continuous input 26 to sequentially activate the multiple light fixtures 20. In simple words, the longer the user makes the input 26, the more light fixtures 20 are illuminated. When the user stops making the input 26, the controller 24 stops illuminating more light fixtures.

Exemplary embodiments thus present an elegant solution. As the reader understands, with conventional lighting controls an occupant must walk the house or office to ensure the lights are on or off. When leaving home or going to bed, for example, a last occupant must walk to every room to ensure every light is off. When arriving home to a dark house, the occupant must walk to each dark room to turn on the lights. Exemplary embodiments, however, allow the single input 26, from the single input device 28, to sequentially activate the multiple light fixtures 20. Time is saved, and safety is enhanced, by controlling the multiple light fixtures 20 from a single location.

Figure 2:
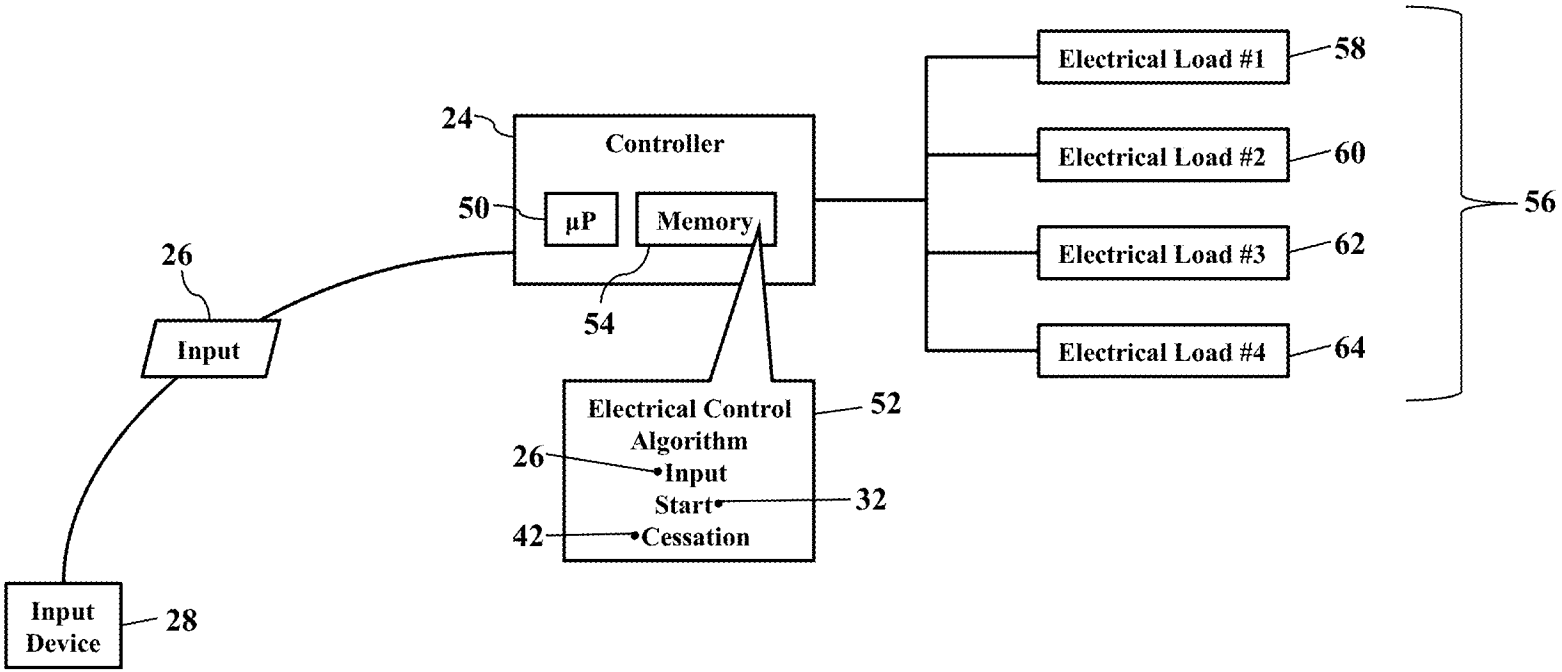
FIG. 2 is a detailed block diagram illustrating a controller, according to exemplary embodiments.

FIG. 2 is a more detailed block diagram illustrating the controller 24, according to exemplary embodiments. The controller 24 may have a processor 50 (e.g., "μP"), application specific integrated circuit (ASIC), or other component that executes an electrical control algorithm 52 stored in a memory 54. The electrical control algorithm 52 is a set of programming, code, or instructions that cause the processor 50 to perform operations of sequentially activating different electrical loads 56 in response to the input 26. When the input 26 is initially received, for example, the electrical control algorithm 52 may instruct the processor to activate a first electrical load 58. Continuous receipt of the input 26 may cause the processor to sequentially activate additional ones of the electrical loads 56 (such as a second electrical load 60 and then a third electrical load 62). At some point, though, the cessation 42 of the input 26 may be determined, such as when the user releases a button or ceases touching a capacitive screen of the input device 28. Whatever the cessation 42, the electrical control algorithm 52 may then instruct the processor to cease activating new ones of the electrical loads 56. In this example, then, the user's input 26 has activated the first electrical load 58, then the second electrical load 60, and lastly the third electrical load 62. A fourth electrical load 64, though, is not activated in response to the cessation 42 of the input 26. The different electrical loads 56 may remain activated until the user performs a deactivation procedure, which later paragraphs will explain.

Figure 3:
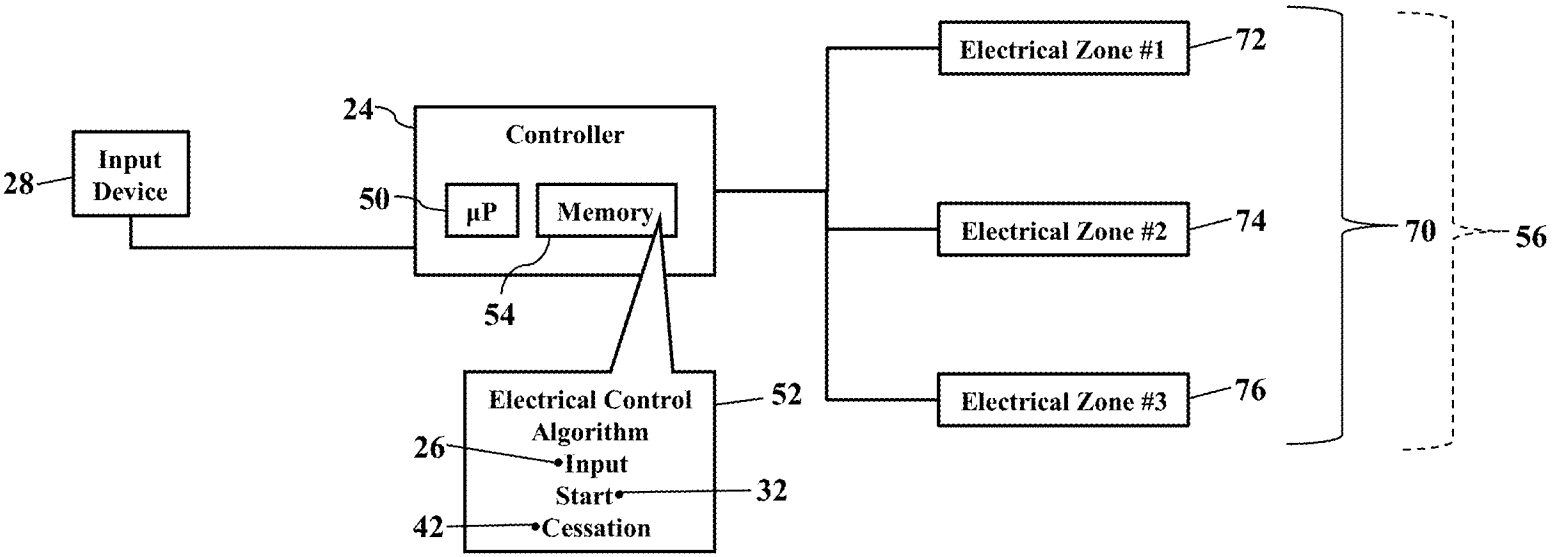
FIG. 3 is a schematic illustrating zonal control, according to exemplary embodiments.

FIG. 3 is a schematic illustrating zonal control, according to exemplary embodiments. Here the controller 24 may sequentially activate different electrical zones 70, in response to the user's input 26. That is, the different electrical loads 56 may be organized into the different electrical zones 70. Each different zone 70 may include a single light fixture or multiple light fixtures. Each different zone 70 may additionally or alternatively include electrical outlets, appliances, and machines. Each different zone 70 may additionally or alternatively include different electrical circuits, which may be sequentially added in response to the user's input 26. Regardless, as the controller 24 continuously receives the user's input 26, the controller 24 sequentially activates the different electrical zones 70. The input 26, for example, may initially activate a first electrical zone 72. Continued receipt of the input 26 may cause the controller 24 to sequentially activate a second electrical zone 74 and then a third electrical zone 76. At the cessation 42 of the input 26, though, the controller 24 ceases activation of more electrical zones 70. The user's input 26 has thus caused the controller 24 to sequentially illuminate any light fixtures (and outlets and appliances) associated with the activated electrical zones 70.

Figure 4:
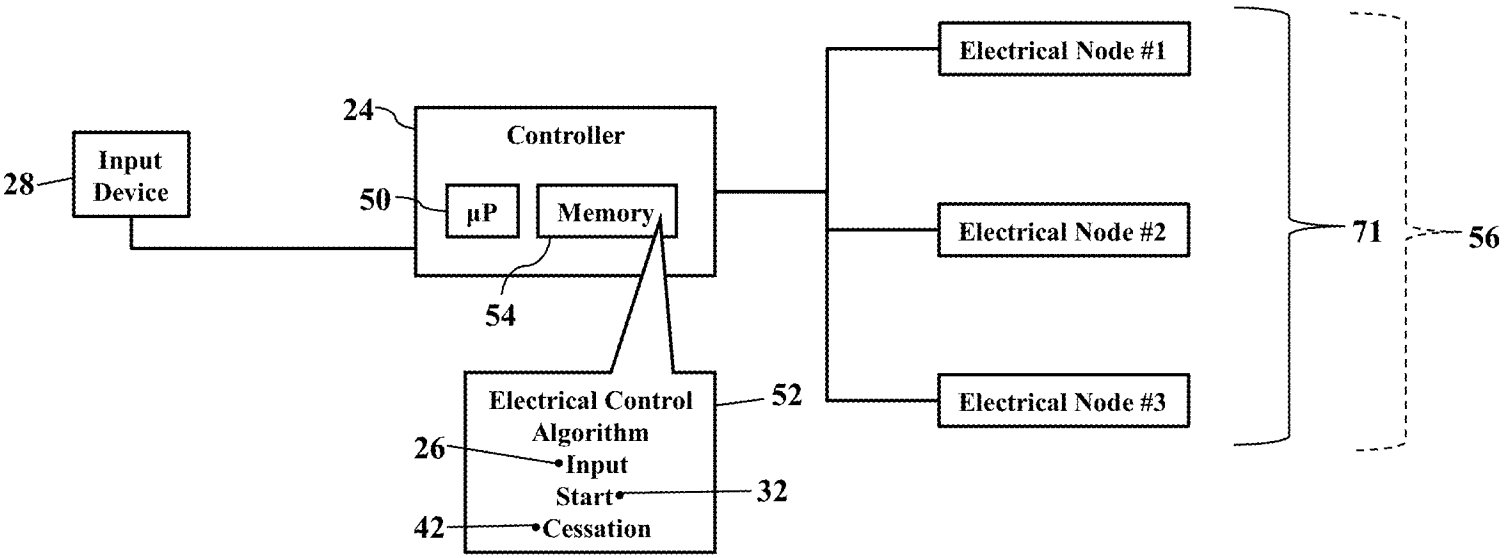
FIG. 4 is a schematic illustrating nodal control, according to exemplary embodiments.

FIG. 4 is a schematic illustrating nodal control, according to exemplary embodiments. Here the controller 24 may sequentially activate different electrical nodes 71, in response to the user's input 26. That is, the different electrical loads 56 may be organized into the different electrical nodes 71. Each different node 71 may include a single light fixture or multiple light fixtures. Each different node 71 may additionally or alternatively include one or more electrical outlets, appliances, and/or machines. Each different node 71 may additionally or alternatively include different electrical circuits, which may be sequentially added in response to the user's input 26. Regardless, as the controller 24 continuously receives the user's input 26, the controller 24 sequentially activates the different electrical nodes 71.

Figure 5:
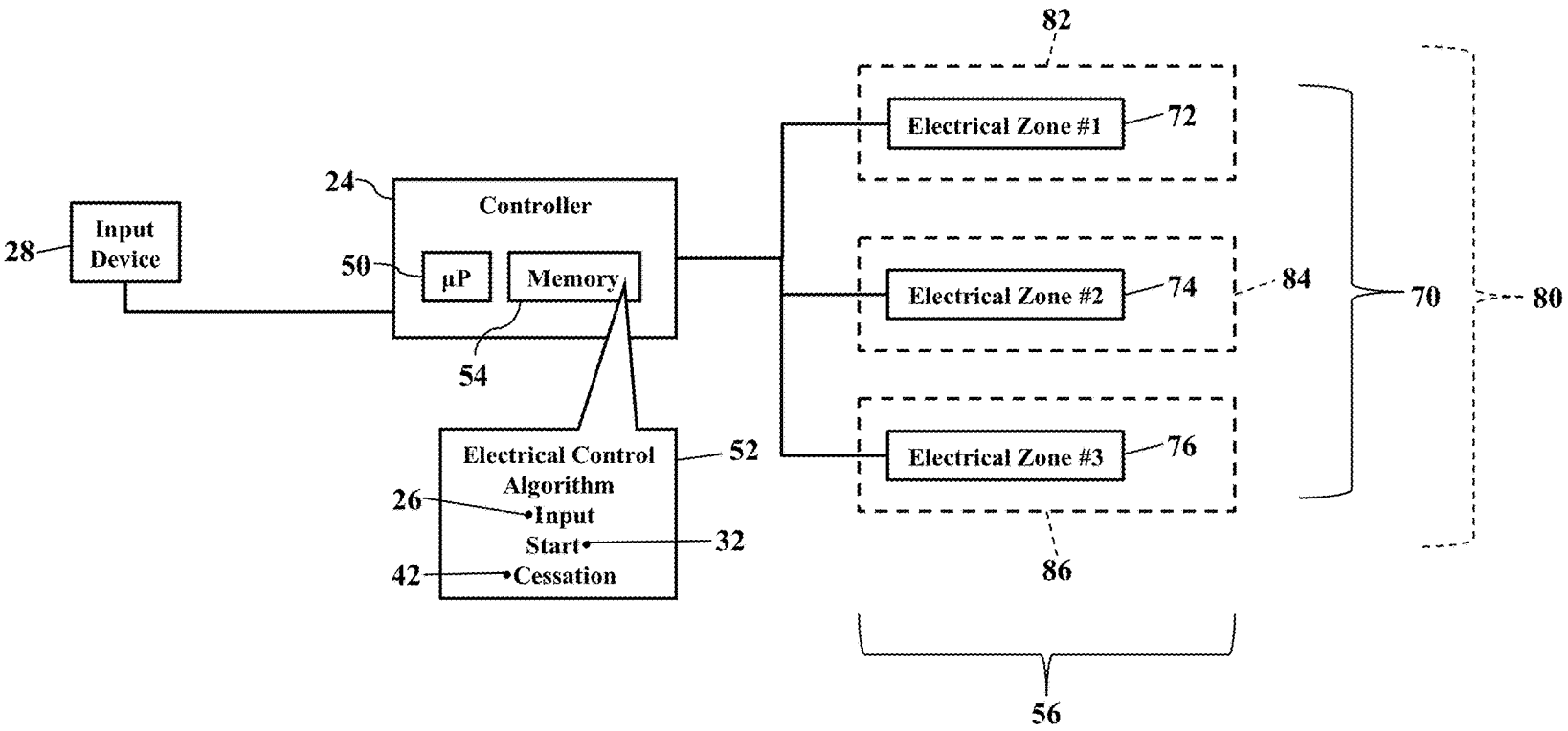
FIG. 5 is a schematic illustrating room control, according to exemplary embodiments.

FIG. 5 is a schematic illustrating room control, according to exemplary embodiments. Here the different electrical loads 56 may be organized or associated with different rooms 80 in a home or business. The user's input 26 may thus cause the controller 24 to initially activate any circuitry, wiring, fixtures, and/or outputs in a first room 82. Continued receipt of the input 26 may cause the controller 24 to electrically activate the circuitry, wiring, fixtures, and/or outputs in a second room 84. Further receipt of the same input 26 may sequentially activate the circuitry, wiring, fixtures, and/or outputs in a third room 86. At the cessation 42 of the input 26, though, the controller 24 may cease electrical activation of more rooms 80.

Electrical control again saves time and improves safety. The user's input 26 causes the controller 24 to perform an instant action of electrically activating the light fixtures 20 in one of the rooms 80. Continued receipt of the user's input 26, for example, illuminates the lights in an adjacent room. The controller 24 may continue expanding illumination of other zones 70 or rooms 80 in response to continuation of the user's input 26. Indeed, the user's input 26 may continue sequentially illuminating additional zones 70 or rooms 80 until the entire home or building is illuminated. So, the user may control the lights from a single location, using the single input device 28.

Figure 6:
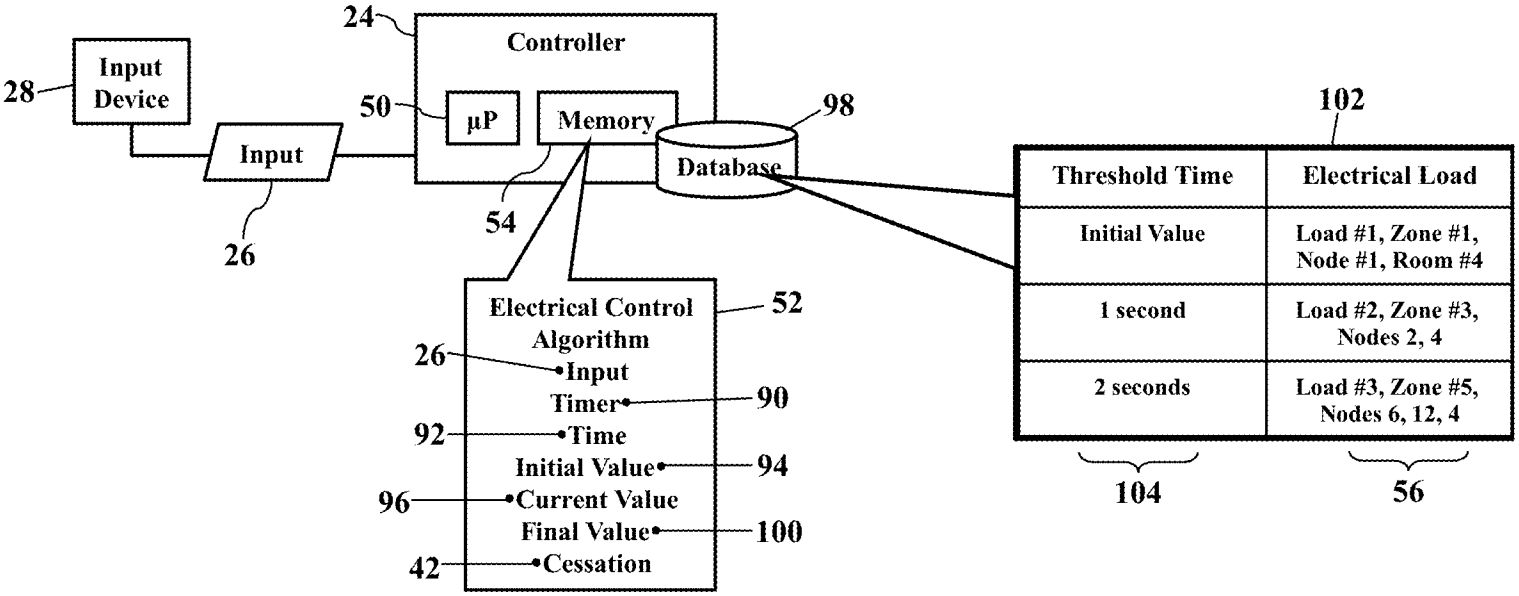
FIG. 6 is a schematic illustrating initializing of a timer, according to exemplary embodiments.

FIG. 6 is a schematic illustrating initializing of a timer 90, according to exemplary embodiments. Here the controller 24 may measure an amount of time 92 of the input 26 received from the input device 28. When the controller 24 initially receives the input 26 from the input device 28, the controller 24 may initialize the timer 90 at an initial value 94 (such as zero). As the timer 90 increments, the controller 24 compares a current value 96 of the timer 90 to entries in a database 98. The timer 90 counts up to a final value 100 at the cessation 42 of the input 26.

The database 98 may be time-based. FIG. 6 illustrates the database 98 as a table 102 that maps, associates, or relates the different electrical loads 56 to different threshold time values 104. While FIG. 6 only illustrates a few entries, in practice the database 98 may have many entries for many different electrical loads, perhaps configured by fixture(s), node(s), room(s), and/or zone(s). Regardless, as the timer 90 increments, the electrical control algorithm 52 causes the processor 50 to compare the current time value 96 of the timer 90 to the entries in the database 98. FIG. 6 illustrates the database 98 as being locally stored in the memory 54 of the controller 24, but the database 98 may be remotely accessed at any network location from any communications network. Regardless, if the processor 50 determines a match between the current time value 96 of the timer 90 and one of the entries in the database 98, then the electrical control algorithm 52 causes the processor 50 to electrically activate the corresponding electrical load(s) 56. FIG. 6 illustrates an example where the electrical loads 56 are sequentially activated at one-second (1 sec.) intervals. The user, however, may thus configure the entries in the database 98 to activate different loads to any length of time of the user's input 26. As long as the user continues the input 26 (such as depressing a button or touching an input screen), the controller 24 may sequentially activate the different electrical loads 56 at the different threshold time values 104 of the timer 90.

Figure 7:
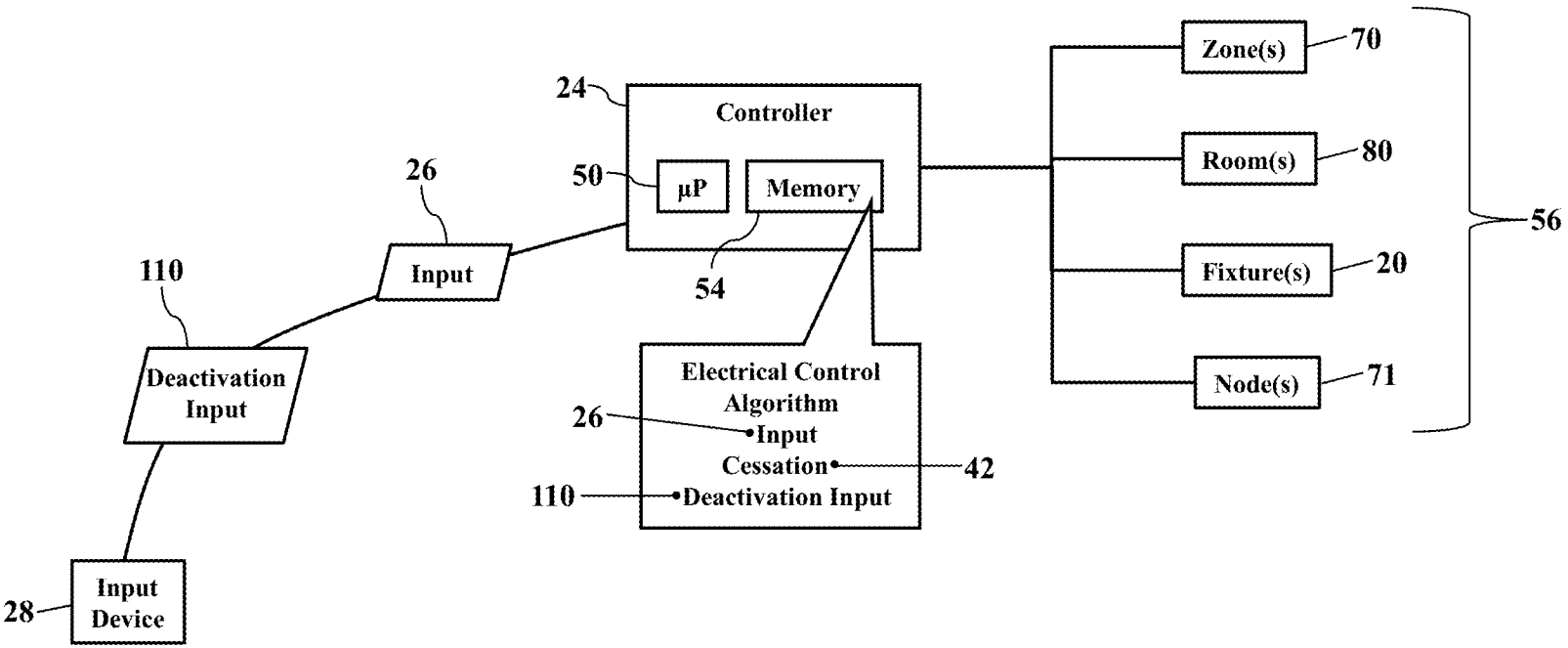
FIGS. 7-8 are schematics illustrating a deactivation procedure, according to exemplary embodiments.
Figure 8:
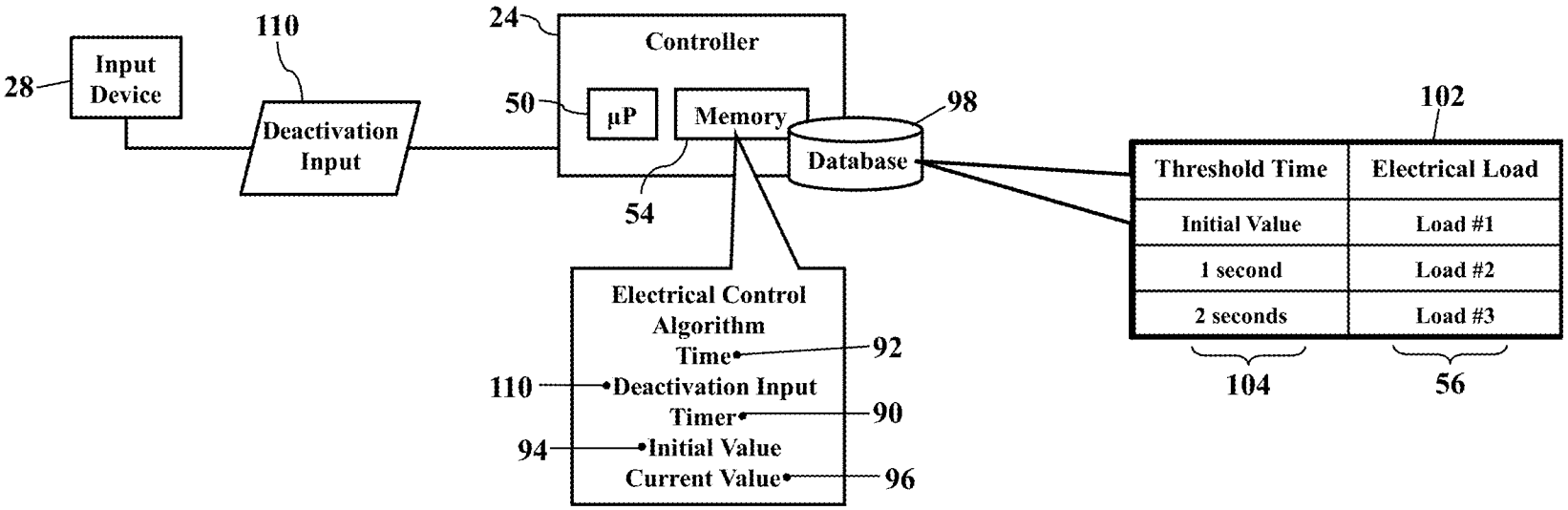

FIGS. 7-8 are schematics illustrating the deactivation procedure, according to exemplary embodiments. Here the user may sequentially deactivate the electrical loads 56 in response to receipt of the user's deactivation input 110. That is, after the cessation 42 of the user's input 26 to the input device 28, the user may make the deactivation input 110 to sequentially turn off the circuitry to the different zones 70, rooms 80, fixtures 20, and/or nodes 71. When the controller 24 determines the cessation 42 of the user's input 26, the controller 24 may then monitor for receipt of the user's subsequent deactivation input 110. The user's deactivation input 110, received after the cessation 42, starts the deactivation procedure.

As FIG. 8 illustrates, deactivation may be sequential. The controller 24 may again measure the amount of time 92 of the user's deactivation input 110 received from the input device 28. When the controller 24 initially receives the deactivation input 110, the controller 24 may initialize the timer 90 at the initial value 94 and begin incrementation. As the timer 90 increments, the controller 24 compares the current value 96 of the timer 90 to the entries in the database 98. When a match is determined, the electrical control algorithm 52 causes the processor 50 to electrically deactivate the corresponding electrical load 56. As long as the user continues the deactivation input 110 (such as depressing a button or touching an input screen), the controller 24 may sequentially deactivate the different electrical loads 56 at the different threshold time values 104 of the timer 90. The controller 24 may stop deactivation when the user's deactivation input 110 ends, or when the last time value entry in the database 98 has been deactivated.

Deactivation may differ from activation. That is, the user may define different entries in the database 98 for activation and for deactivation. There may be one set of entries for activating a sequence of the loads 56. There may also be a different set of entries for deactivating the same, or a different, sequence of loads 56. Some users may want fast activation but slower deactivation. Other users may wish that different rooms be activated from those deactivated. Regardless, activation and deactivation may be differently configured to suit a user's preferences.

Figure 9:
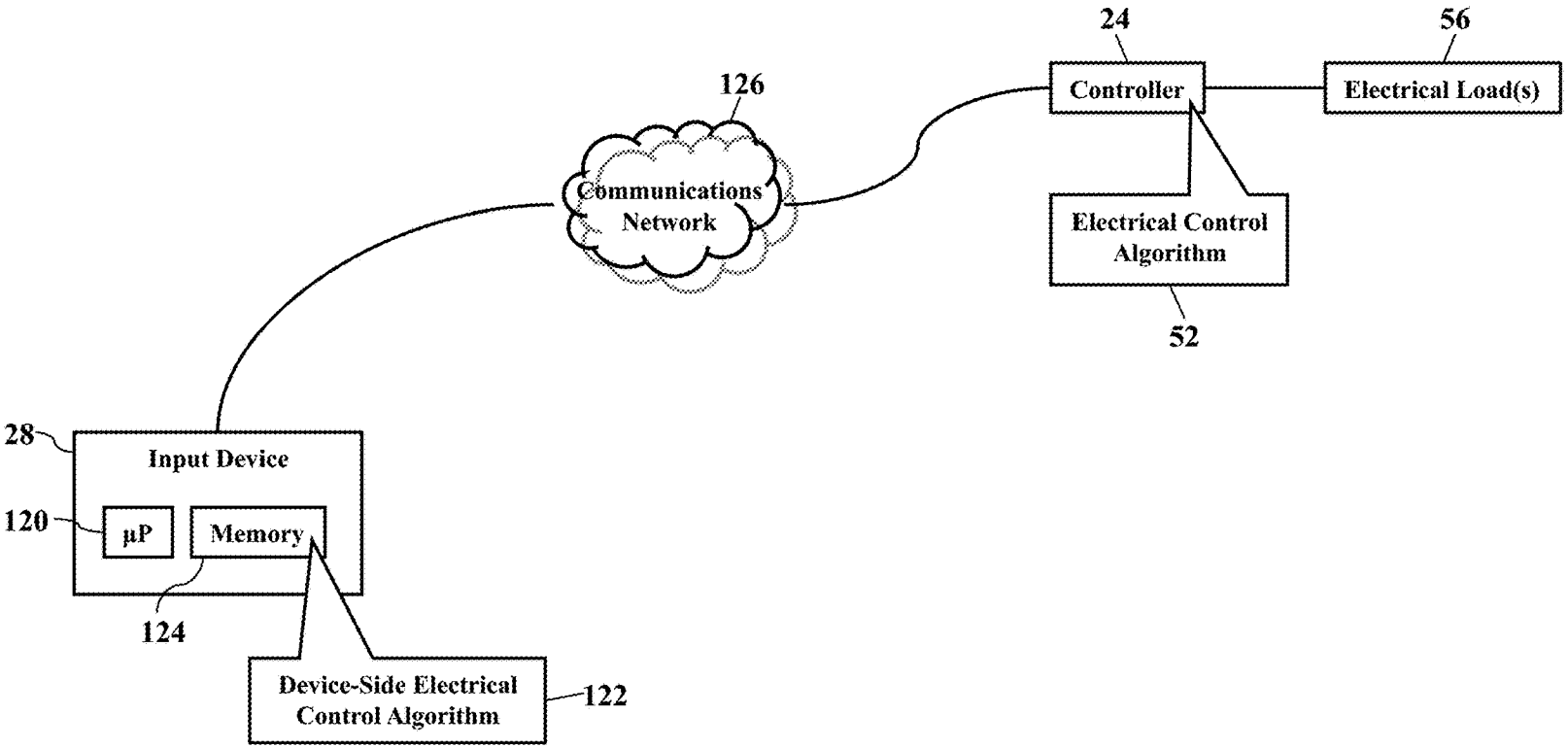
FIGS. 9-11 are schematics illustrating remote operation, according to exemplary embodiments.
Figure 10:
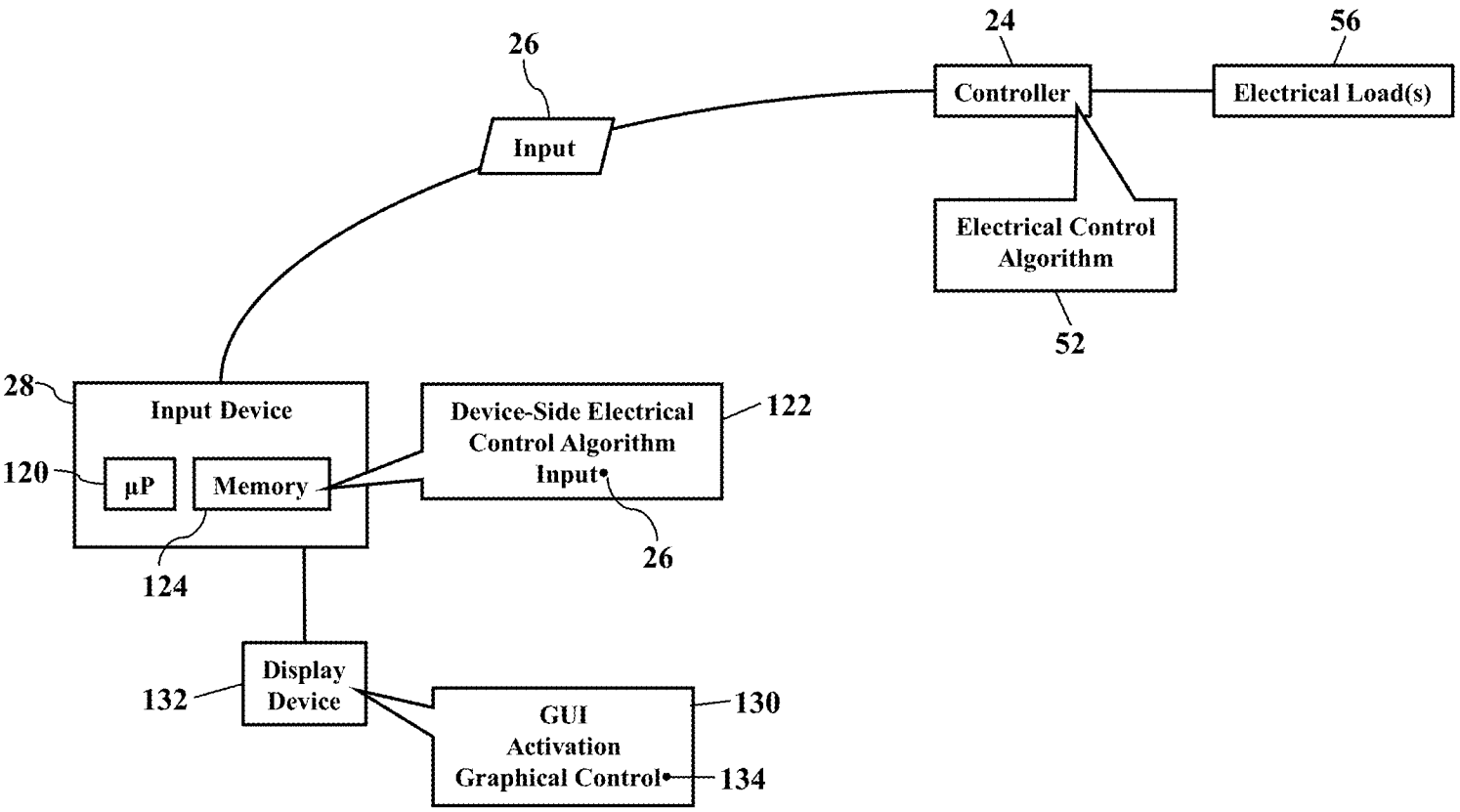
Figure 11:
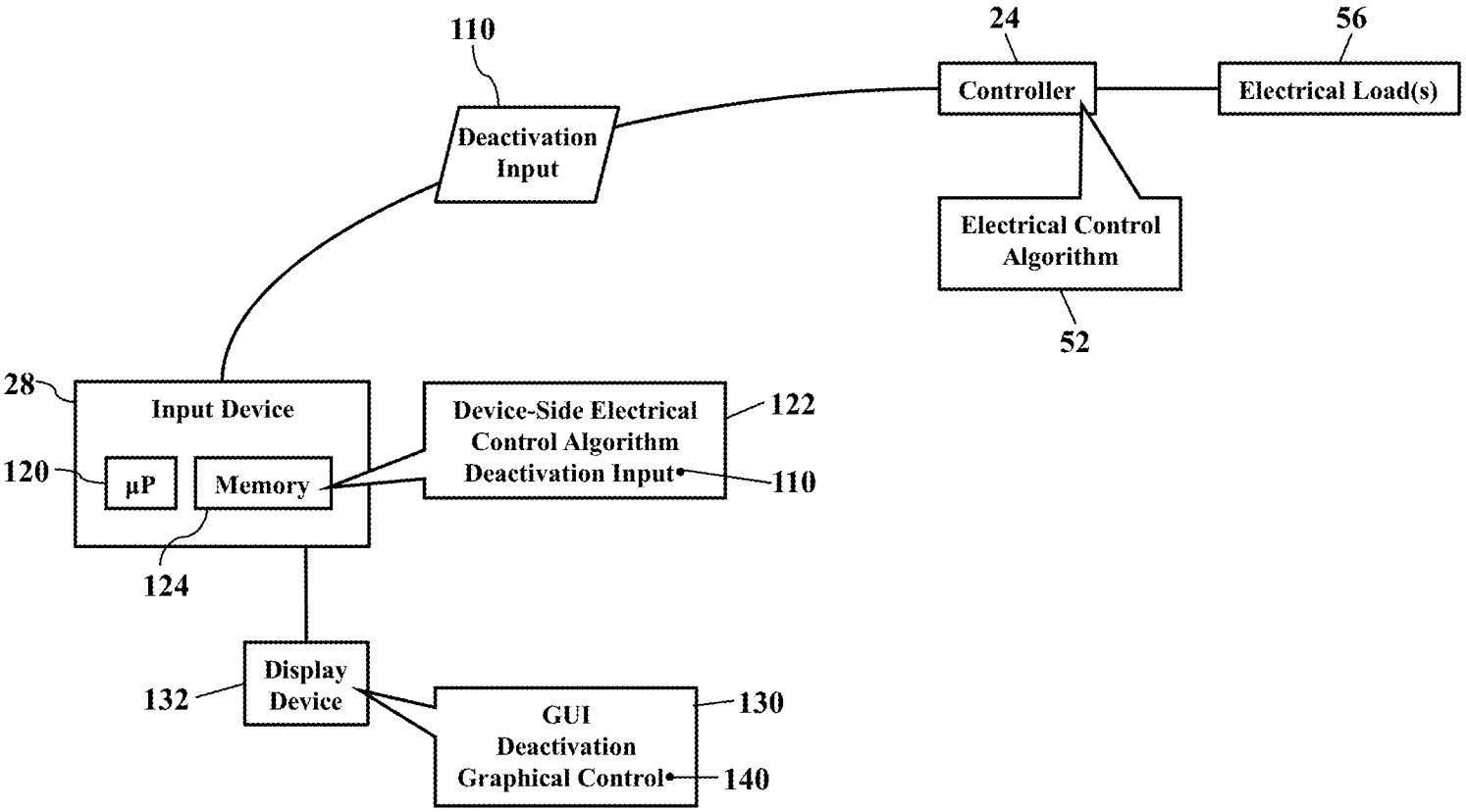

FIGS. 9-11 are schematics illustrating remote operation, according to exemplary embodiments. Here the input device 28 may be used to remotely activate, or deactivate, the electrical loads 56 in the home or business. FIG. 9 illustrates the input device 28 having a processor 120 (e.g., "μP"), application specific integrated circuit (ASIC), or other component that executes a device-side electrical control algorithm 122 stored in a memory 124. The device-side electrical control algorithm 122 may cooperate with the electrical control algorithm 52 using a communications network 126 to remotely activate the electrical loads 56 managed by the controller 24.

FIG. 10 illustrates remote activation. The device-side electrical control algorithm 122 may cause the input device 28 to generate a graphical user interface (or "GUI") 130 on a display device 132. The graphical user interface 130 may display an activation graphical control 134 that, when touched or selected, causes the device-side electrical control algorithm 122 to generate the input 26. The input device 28 sends the input 26 into the communications network (illustrated as reference numeral 126 in FIG. 9) to a network address associated with the controller 24. For example, the input 26 may be sent in an Internet protocol packet, message, or command over a WI-FI® and/or cellular network. When the controller 24 receives the input 26, the controller 24 may begin activation of the electrical loads 56. As the user of the input device 28 continues touching or selecting the activation graphical control 134, the input 26 is repeatedly, continuously, or periodically sent to sequentially activate additional loads 56, as this disclosure explains. The input device 28 may cease sending the input 26 when the user ceases touching or selecting the activation graphical control 134.

FIG. 11 illustrates remote deactivation. Here the device-side electrical control algorithm 122 may cause the input device 28 to generate and display a deactivation graphical control 140. When the user touches or selects the deactivation graphical control 140, the device-side electrical control algorithm 122 generates the deactivation input 110. The input device 28 sends the deactivation input 110 into the communications network (illustrated as reference numeral 126 in FIG. 9) to the network address associated with the controller 24. When the controller 24 receives the deactivation input 110, the controller 24 may begin deactivation of the electrical loads 56. As the user of the input device 28 continues touching or selecting the deactivation graphical control 140, the deactivation input 110 is repeatedly, continuously, or periodically sent to sequentially deactivate the electrical loads 56, as this disclosure explains. The input device 28 may cease sending the deactivation input 110 when the user ceases touching or selecting the deactivation graphical control 140.

Exemplary embodiments may be applied regardless of networking environment. As the above paragraphs mentioned, the communications network 126 may be a wireless network having cellular, WI-FI®, and/or BLUETOOTH® capability. The communications network 126, however, may be a cable network operating in the radio-frequency domain and/or the Internet Protocol (IP) domain. The communications network 126, however, may also include a distributed computing network, such as the Internet (sometimes alternatively known as the "World Wide Web"), an intranet, a local-area network (LAN), and/or a wide-area network (WAN). The communications network 126 may include coaxial cables, copper wires, fiber optic lines, and/or hybrid-coaxial lines. The communications network 126 may even include wireless portions utilizing any portion of the electromagnetic spectrum and any signaling standard (such as the IEEE 802 family of standards, GSM/CDMA/TDMA or any cellular standard, and/or the ISM band). The communications network 126 may even include power line portions, in which signals are communicated via electrical wiring. The concepts described herein may be applied to any wireless/wireline communications network, regardless of physical componentry, physical configuration, or communications standard(s).

Figure 12:
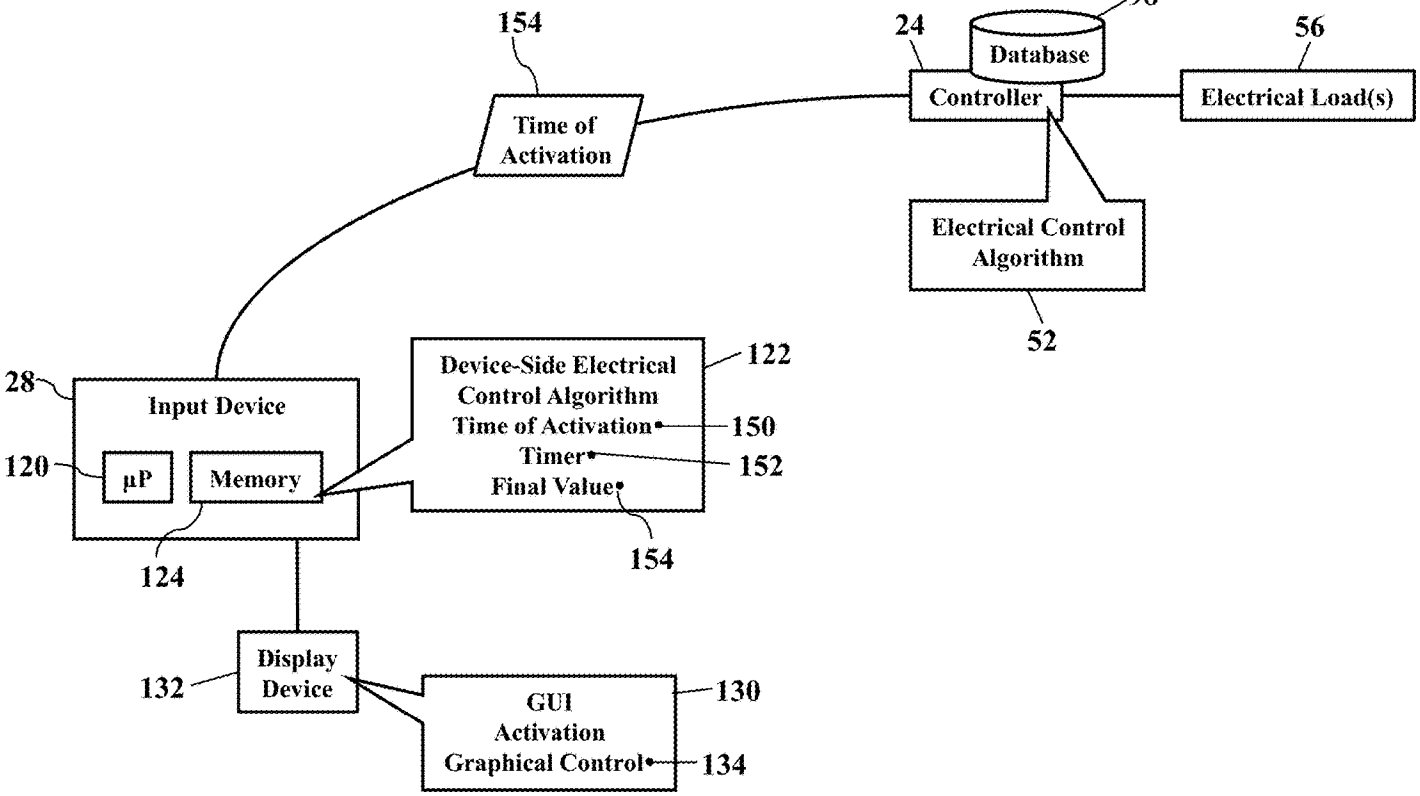
FIGS. 12-13 are schematics further illustrating remote operation, according to exemplary embodiments.
Figure 13:
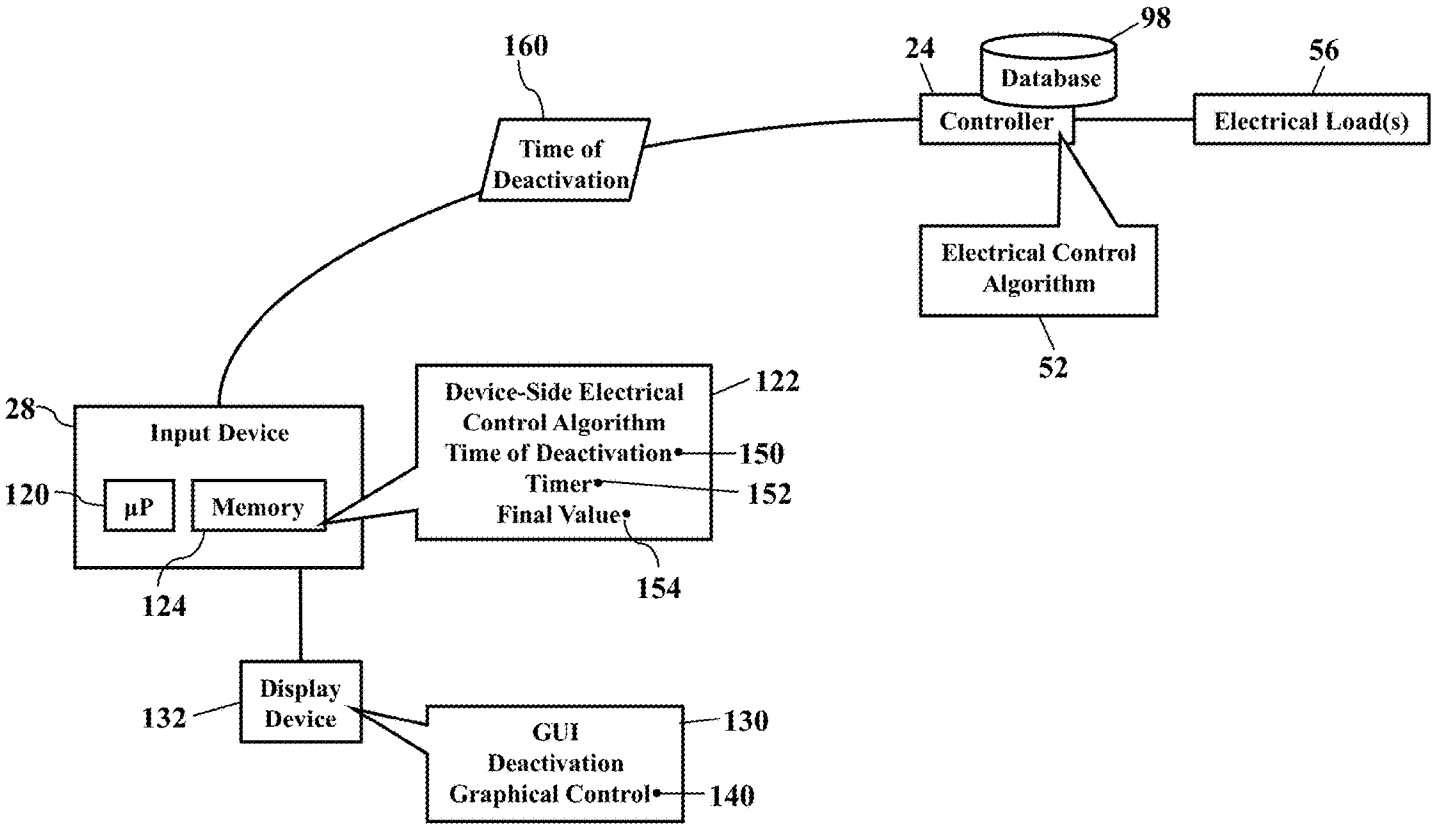

FIGS. 12-13 are schematics further illustrating remote operation, according to exemplary embodiments. FIG. 12 illustrates remote activation that times the user's input 26. When the user touches or selects the activation graphical control 134, here the device-side electrical control algorithm 122 determines a time 150 of activation. That is, when the user initially touches or selects the activation graphical control 134, the device-side electrical control algorithm 122 may initialize a device-side timer 152 that begins counting the time 150 of activation. The device-side timer 152, for example, counts up from zero (0) to a final value 154 at which the user ceases touching or selecting the activation graphical control 134. The input device 28 sends the final value 154 as the time 150 of activation to the network address associated with the controller 24. When the controller 24 receives the time 150 of activation, the controller 24 queries the database 98 for the entries less than or equal to the time 150 of activation. The controller 24 may thus sequentially activate all the electrical loads 56 defined in the database 98 that fall within the time 150 of activation. Here, then, exemplary embodiments need only send a single message to the controller 24, thus conserving processor resources and communications costs.

FIG. 13 illustrates remote deactivation. Here the user again touches or selects the deactivation graphical control 134 to deactivate the electrical loads 56 managed by the controller 24. When the user touches or selects the deactivation graphical control 140, here the device-side electrical control algorithm 122 determines a time 160 of deactivation. That is, when the user initially touches or selects the deactivation graphical control 140, the device-side electrical control algorithm 122 may initialize the device-side timer 152 that begins counting the time 160 of deactivation. The device-side timer 152, for example, counts up from zero (0) to the final value 154 at which the user ceases touching or selecting the deactivation graphical control 140. The input device 28 sends the final value 154 as the time 160 of deactivation to the controller 24. When the controller 24 receives the time 160 of deactivation, the controller 24 queries the database 98 for the entries less than or equal to the time 160 of deactivation. The controller 24 may thus sequentially activate all the electrical loads 56 defined in the database 98 that fall within the time 160 of deactivation.

Figure 14:
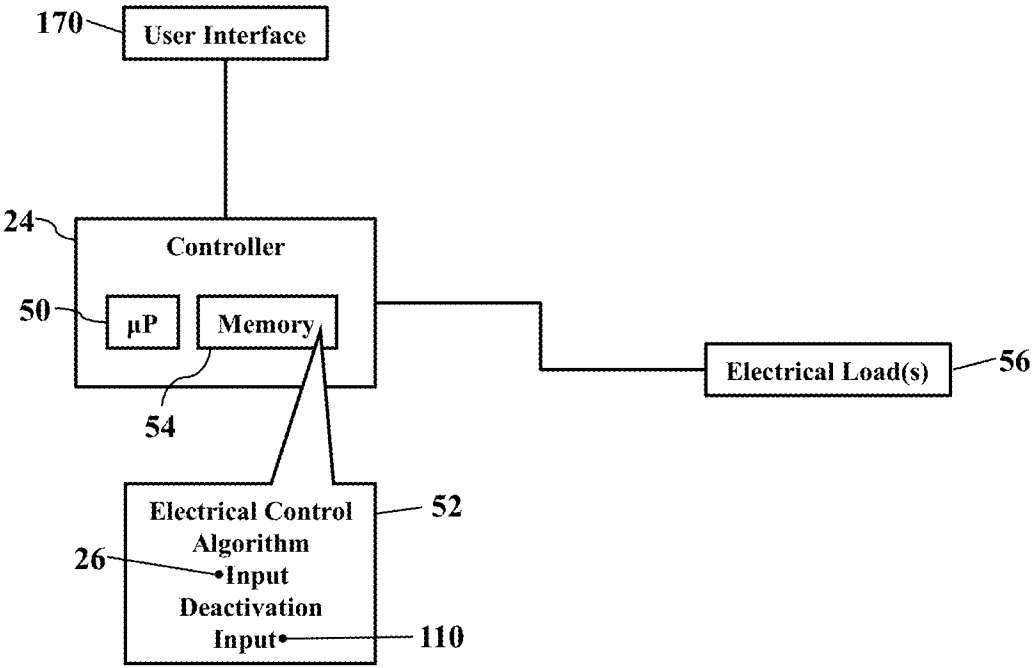
FIG. 14 is a schematic further illustrating the controller, according to exemplary embodiments.

FIG. 14 is a schematic further illustrating the controller 24, according to exemplary embodiments. Here the controller 24 may have a user interface 170 that accepts the input 26 from the user. The user interface 170, for example, may be a touch screen that responds to finger/palm inputs. The user interface 170, however, may also include a physical button, key, or other tactile mechanism. The controller 24 may be hard wired to the electrical loads 56 managed by the controller 24, and/or the controller 24 may wirelessly interface with the electrical loads 56 managed by the controller 24. Regardless, the user thus makes the input 26 at the user interface 170, and the controller 24 sequentially activates the electrical loads 56, as this disclosure explains. The user interface 170 may also accept the deactivation input 110, causing the controller 24 to sequentially deactivate the electrical loads 56, as this disclosure also explains.

Figure 15:
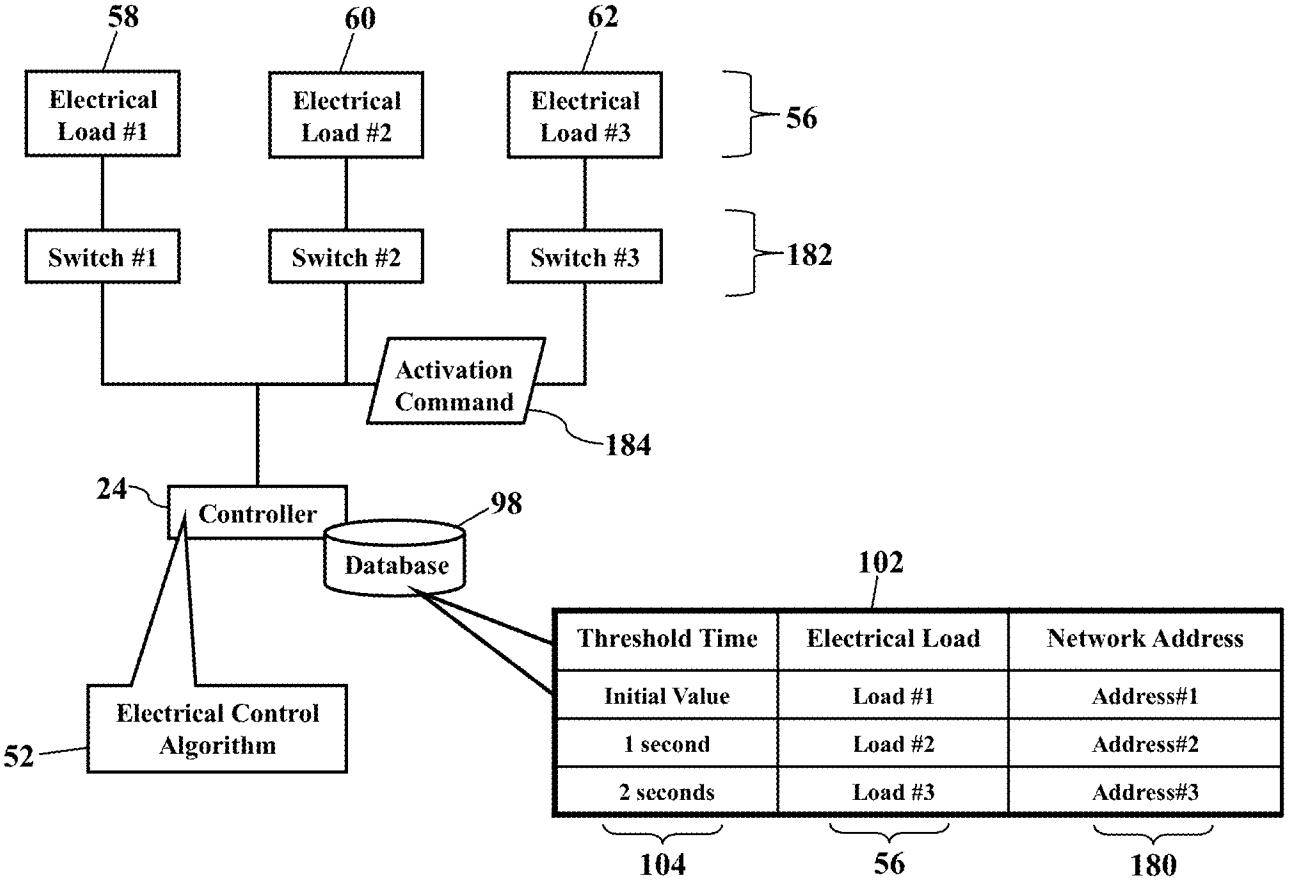
FIG. 15 is a schematic illustrating addressable control, according to exemplary embodiments.

FIG. 15 is a schematic illustrating addressable control, according to exemplary embodiments. Here each electrical load 56 may be associated with a corresponding network address 180. Each network address 180 is assigned to a corresponding remote switch 182 that interfaces with the controller 24. When the controller 24 needs to activate one of the electrical loads 56, here the controller 24 retrieves the corresponding network address 180 associated with the electrical load 56. The controller 24 then sends an activation command 184 to the network address 180 to activate the electrical load 56. The activation command 184 may be sent into the communications network (illustrated as reference numeral 126 in FIG. 9). The controller 24, for example, may send a sequence of the activation commands 184 according to the times in the database 98.

Figure 16:
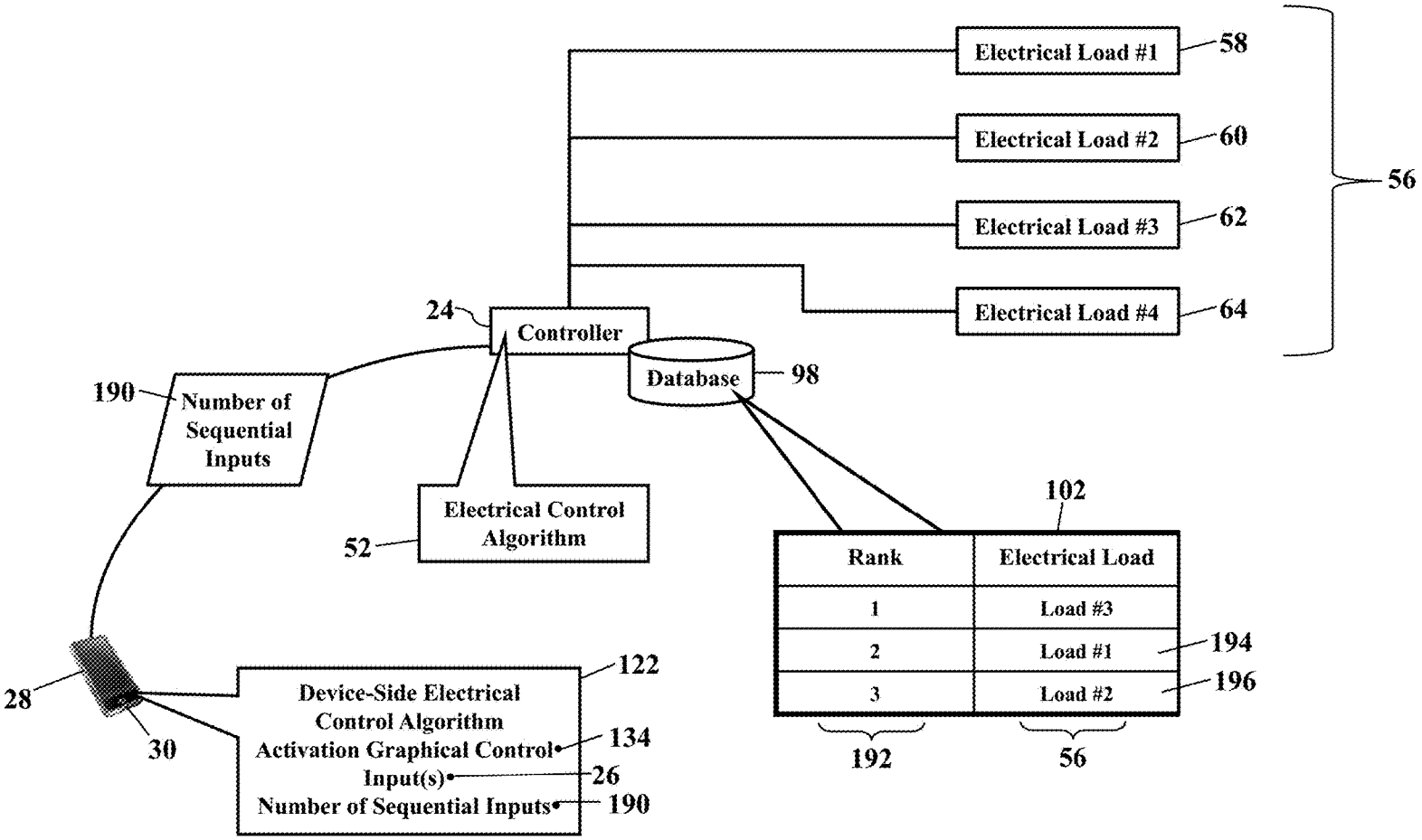
FIG. 16 is another schematic illustrating the controller, according to exemplary embodiments.

FIG. 16 is another schematic illustrating the controller 24, according to exemplary embodiments. Here the controller 24 sequentially activates the electrical loads 56 based on sequential inputs to the input device 28. The user, for example, may make a sequence of touches (or "taps") on the button or touch screen of the input device 28. The controller 24 then sequentially activates the same number of electrical loads 56 defined in the database 98. FIG. 15, for example, illustrates the activation graphical control 134 generated by the user's smartphone 30. Suppose the user makes four separate inputs "taps" of the activation graphical control 134. The device-side electrical control algorithm 122 counts the number 190 of sequential inputs (or taps) and sends the number 190 to the controller 24. When the controller 24 receives the number 190 of sequential inputs, the electrical control algorithm 52 causes the controller 24 to query the database 98 for the matching number of ranked entries. As FIG. 16 illustrates, the entries in the database 98 may be prioritized or ranked 192 for activation. One (1) "tap" of the activation graphical control 134, for example, causes the controller 24 to activate the correspondingly first ranked (or highest priority) electrical load 56 (illustrated as reference numeral 194). Two (2) "taps" of the activation graphical control 134 would activate ranked entry #1 and ranked entry #2 (illustrated, respectively, as reference numerals 194 and 196). The user's sequence of inputs is thus translated into ranked activations. The controller 24 may electrically activate the corresponding electrical loads 56 in sequence or nearly simultaneously, depending on the user's configuration.

Deactivation may be similarly accomplished. The user may make a sequence of touches (or "taps") on the button or touch screen of the input device 28, and the controller 24 then sequentially deactivates the same number of electrical loads 56 defined in the database 98. The user, for example, may make four separate inputs "taps" of the deactivation graphical control (illustrated as reference numeral 140 in FIG. 11). The device-side electrical control algorithm 122 counts the number 190 of sequential deactivation inputs (or taps) and notifies the controller 24. The controller 24 queries the database 98 for the matching number of ranked entries and deactivates the same number of ranked electrical loads 56.

Figure 17:
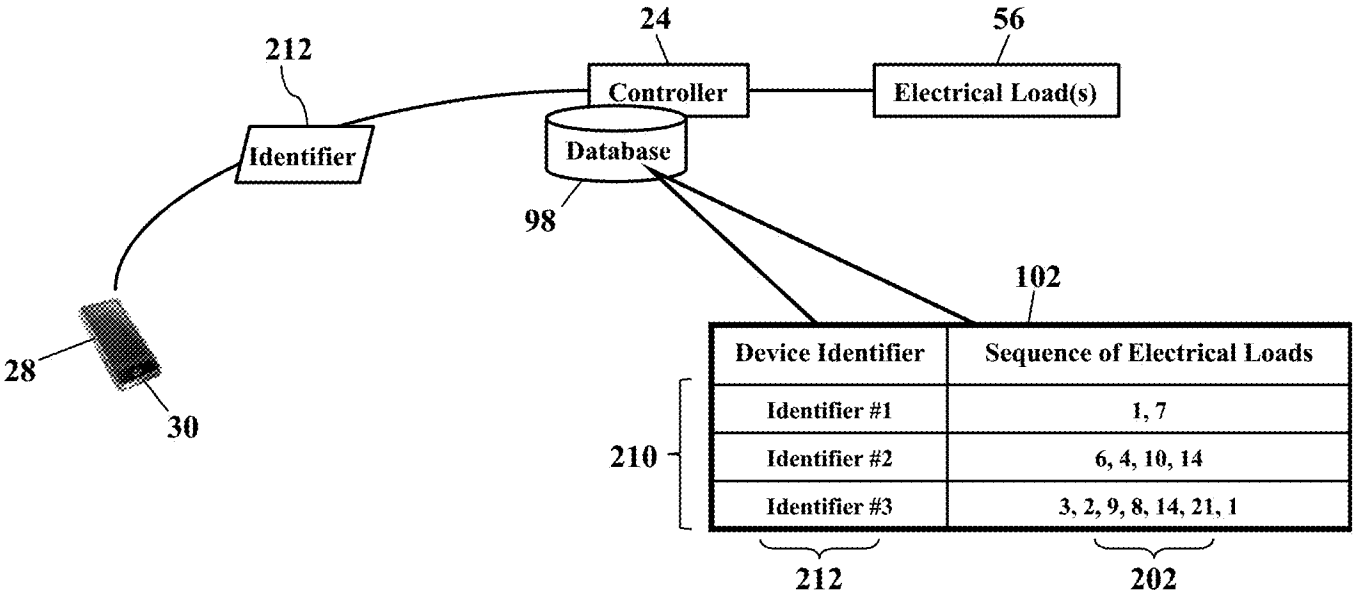
FIG. 17 is a schematic illustrating personalized profiles, according to exemplary embodiments.

FIG. 17 is a schematic illustrating personalized profiles 210, according to exemplary embodiments. As the reader may imagine, there may be many people sharing a home or office. Each sharing user may have different preferences for activating, and deactivating, the lights and other electrical loads 56 in the home or office. Exemplary embodiments, then, may retrieve a profile 210 associated with each different user. Each profile 210 stores the activation, and/or deactivation, sequences defined by the respective user. So, when the input device 28 communicates with the controller 24, the corresponding profile 210 may be retrieved.

As FIG. 17 illustrates, the profile 210 may be organized by device identifier 212. As those of ordinary skill understand, each different input device 28 may have a unique alphanumeric device identifier 212. The user's smartphone 30, for example, may be uniquely identified by its telephone number, IP address, media access control address (or "MAC address"), or any other differentiator. The entries in the database 98, then, may be grouped or arranged according to different device identifiers 212 of different input devices 28. So, when any input device 28 sends information to the controller 24, the input device 28 may report or self-identify its corresponding device identifier 212. The controller 24 uses the device identifier 212 to retrieve or locate the corresponding sequence 202 of electrical loads. So, even though the controller 24 may communicate with multiple input devices 28, the controller 24 may sequentially activate/deactivate a particular user's desired electrical loads 56. Each profile 210 may be further organized according to the location 200, as explained with reference to FIGS. 16-17.

Figure 18:
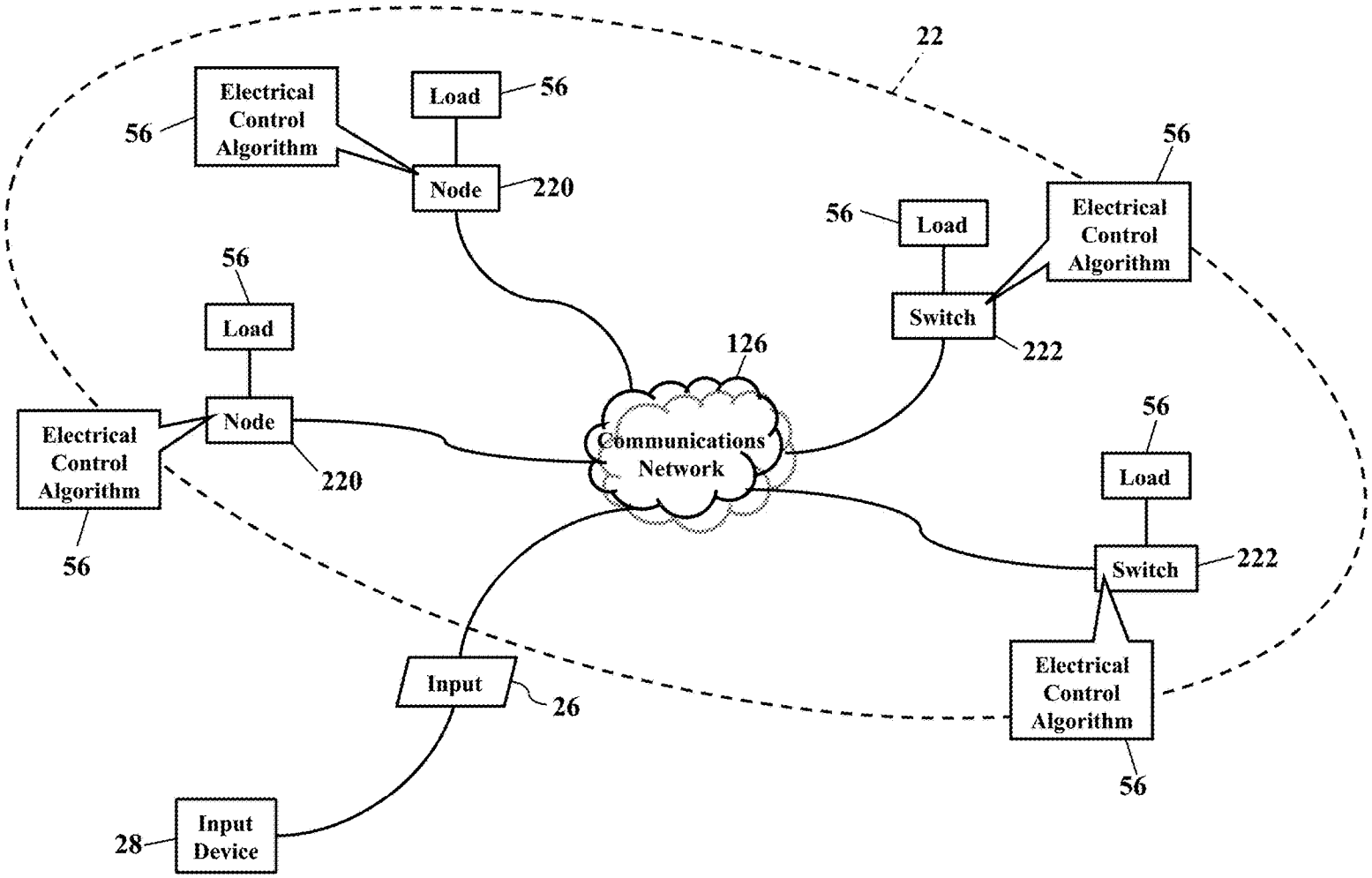
FIGS. 18-19 are more schematics illustrating the operating environment, according to exemplary embodiments
Figure 19:
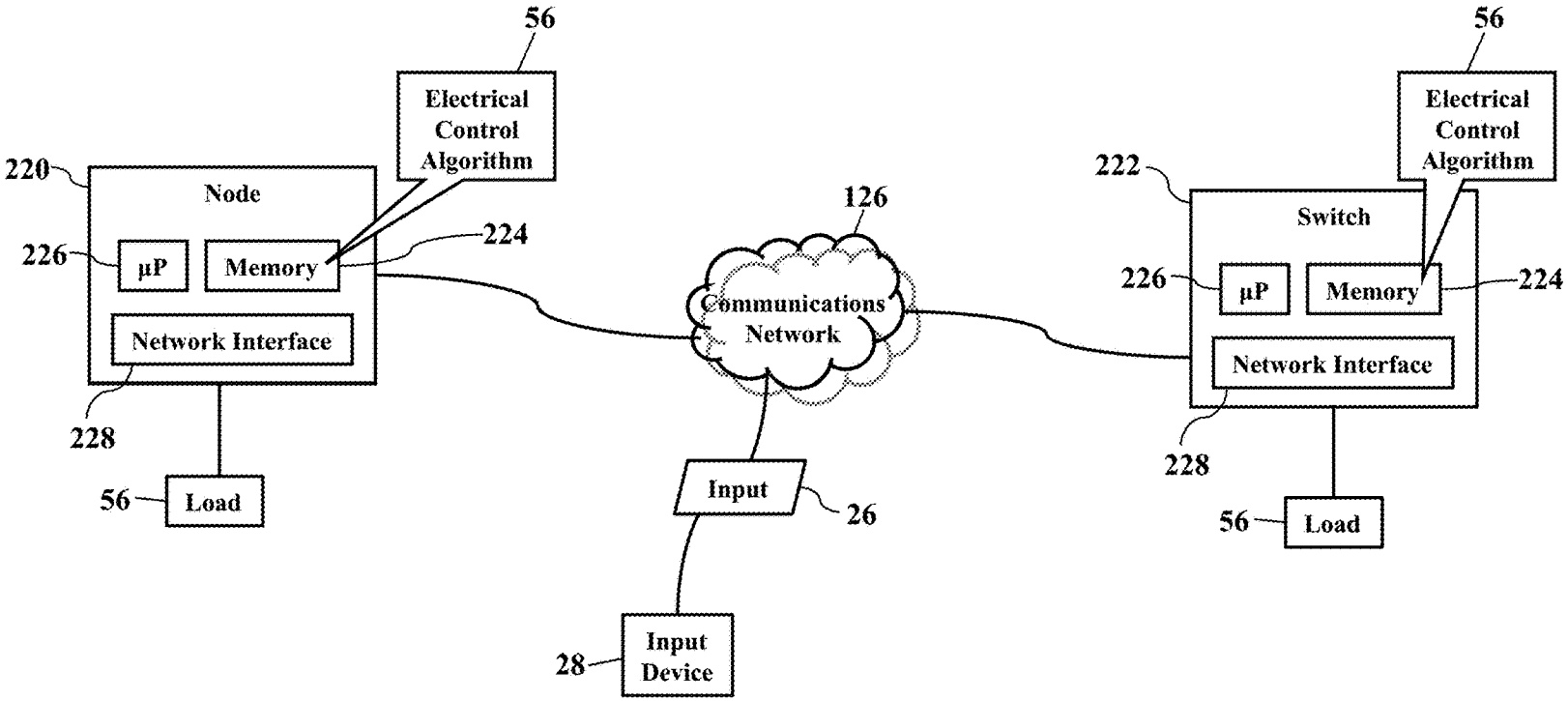

FIGS. 18-19 are more schematics illustrating the operating environment, according to exemplary embodiments. Here, each individual node 220 and/or switch 222 in the lighting environment 22 may intelligently control its corresponding load 20. That is, each individual node 220 and switch 222 may execute any functional capability of the electrical control algorithm 56. The nodes 220 and switches 222 may communicate using the communications network 126 and execute at least a portion of the electrical control algorithm 56. The input 26 may be broadcast and received by one, some, or all the nodes 220 and switches 222 in the lighting environment 22, or the input 26 may be addressed to the network address assigned to each node 220 and switch 222. When the input 26 is received, each node 220 and/or switch 222 may inspect the input 26 and autonomously decide whether sequential activation or deactivation is required, as this disclosure explains.

As FIG. 19 illustrates, the node 220 and switch 222 may be processor controlled. The electrical control algorithm 56 may be stored in memory 224, and a processor 226 may execute the electrical control algorithm 56. Each node 220 and switch 222 may have a network interface 228 to receive the input 26 sent from the input device 28. Each node 220 and switch 222, for example, may have WI-FI® radio or BLUETOOTH® ISM capability to wirelessly receive the input 26. The network interface 228, however, may also be a wired ETHERNET® connection using physical wires (such as electrical service cables). Whatever the network interface 228, each node 220 and switch 222 inspects the input 26 and activates, or deactivates, its corresponding load 20, as this disclosure explains.

Figure 20:
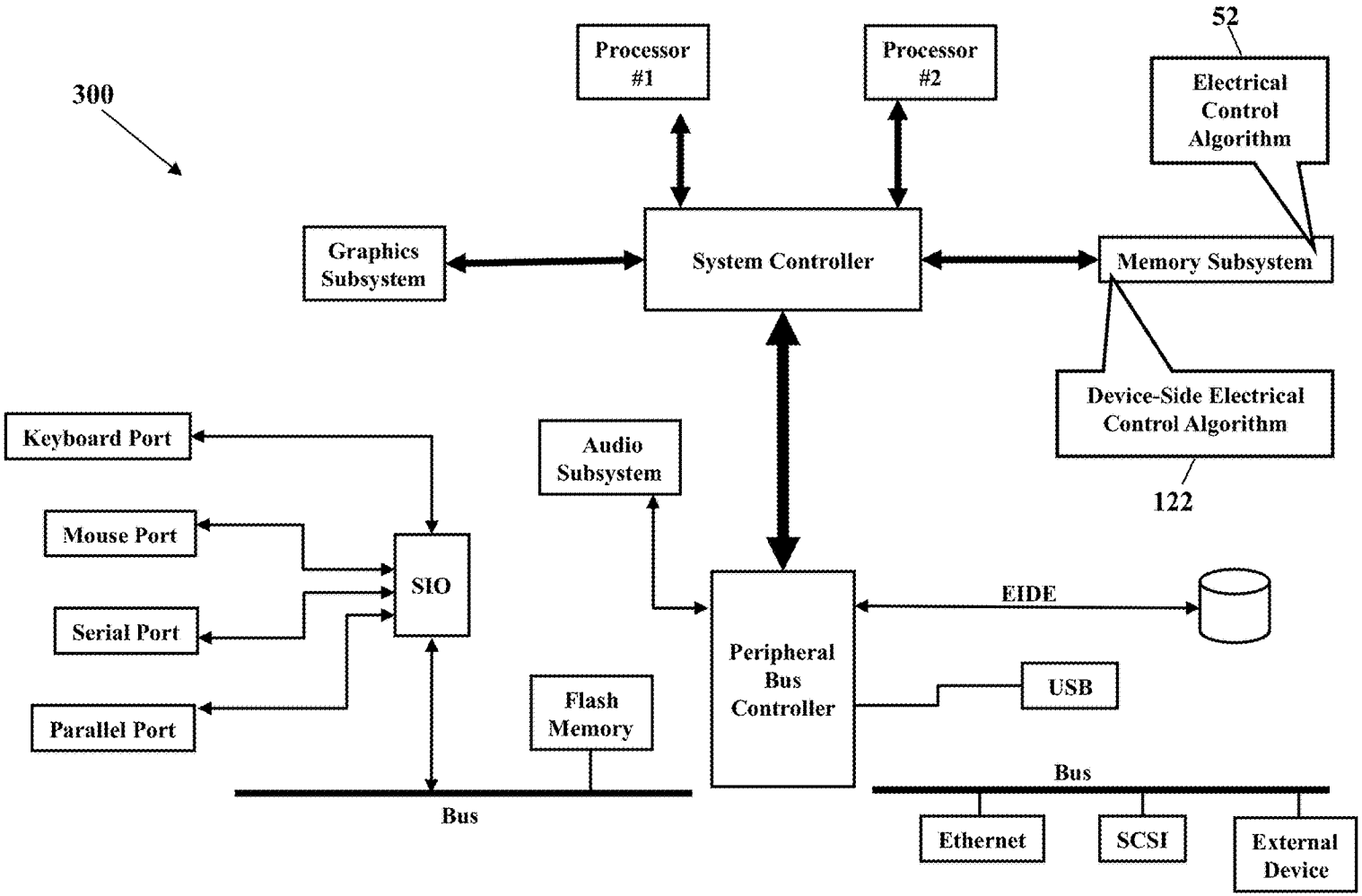
FIGS. 20-21 are schematics illustrating still more exemplary embodiments.

FIG. 20 is a schematic illustrating still more exemplary embodiments. FIG. 20 is a more detailed diagram illustrating a processor-controlled device 300. As earlier paragraphs explained, the electrical control algorithm 52 and the device-side electrical control algorithm 122 may operate in any processor-controlled device. FIG. 20, then, illustrates the electrical control algorithm 52 and the device-side electrical control algorithm 122 stored in a memory subsystem of the processor-controlled device 300. One or more processors communicate with the memory subsystem and execute either, some, or all applications. Because the processor-controlled device 300 is well known to those of ordinary skill in the art, no further explanation is needed.

Figure 21:
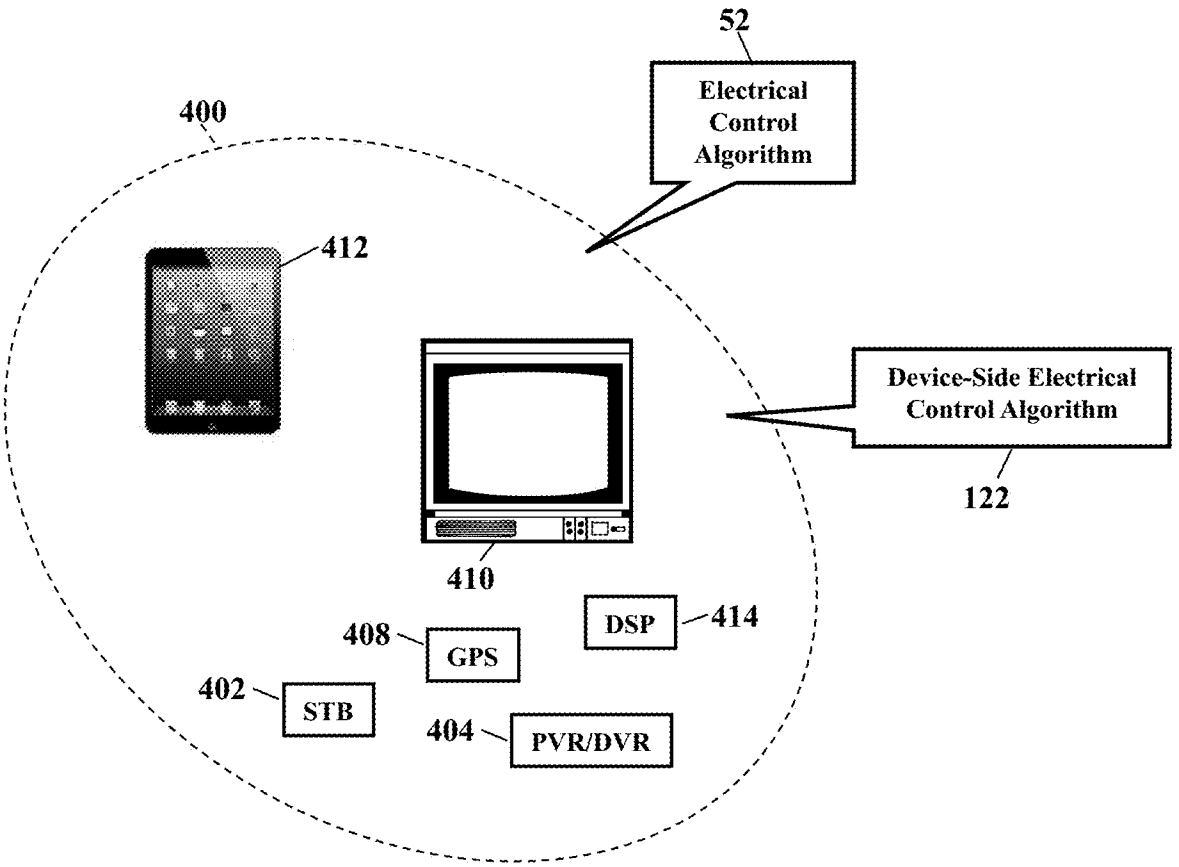

FIG. 21 depicts other possible operating environments for additional aspects of the exemplary embodiments. FIG. 21 illustrates the electrical control algorithm 52 and the device-side electrical control algorithm 122 operating within various other devices 400. FIG. 21, for example, illustrates that the electrical control algorithm 52 and/or the device-side electrical control algorithm 122 may entirely or partially operate within a set-top box ("STB") (402), a personal/digital video recorder (PVR/DVR) 404, a Global Positioning System (GPS) device 408, an interactive television 410, a tablet computer 412, or any computer system, communications device, or processor-controlled device utilizing the processor 50 and/or a digital signal processor (DP/DSP) 414. The device 400 may also include network switches, routers, modems, watches, radios, vehicle electronics, clocks, printers, gateways, mobile/implantable medical devices, and other apparatuses and systems. Because the architecture and operating principles of the various devices 400 are well known, the hardware and software componentry of the various devices 400 are not further shown and described.

Figure 22:
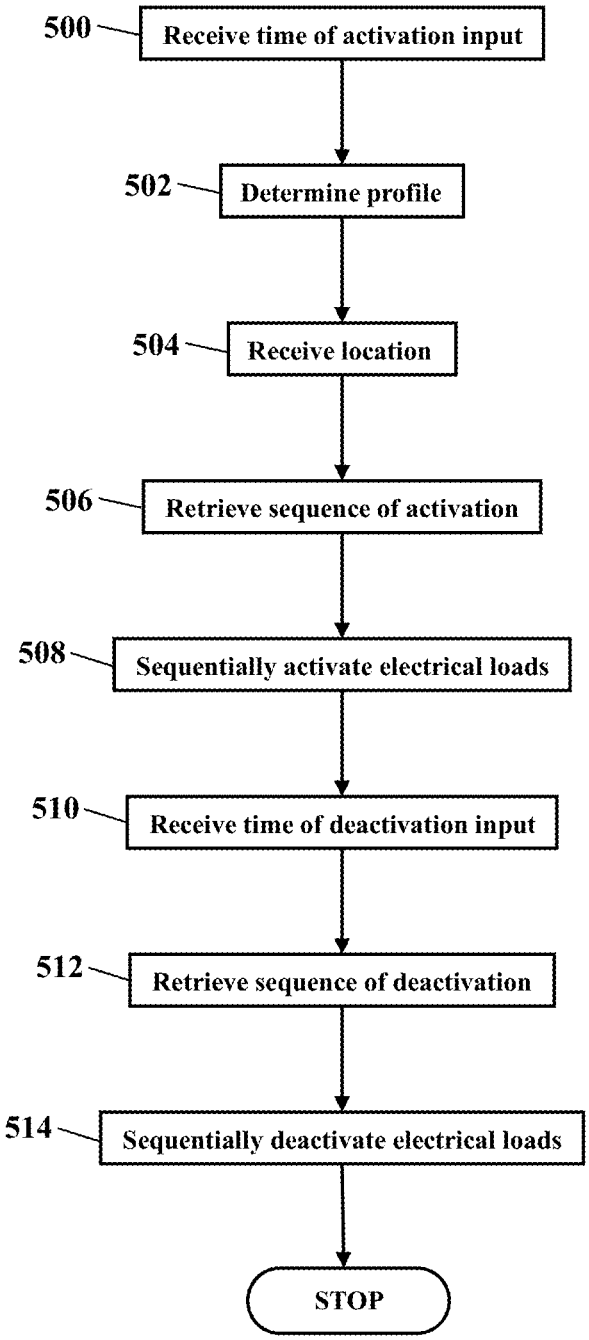
FIG. 22 is a flowchart illustrating a method or algorithm for electrical control, according to exemplary embodiments.

FIG. 22 is a flowchart illustrating a method or algorithm for electrical control, according to exemplary embodiments. The time 92 of the input 26 is received from the input device 28 (Block 500). The profile 210 associated with the input device 28 is determined (Block 502). The location 200 of the input device 28 is received (Block 504). A sequence of activation is retrieved (Block 506). The sequence of activation may be associated with the time 92 and the input device 28 and/or the location 200 and the input device 28. The corresponding electrical loads 56 are activated, according to the sequence of activation (Block 508). The time 92 of the deactivation input 110 is subsequently received from the input device 28 (Block 510). A sequence of deactivation is retrieved (Block 512). The sequence of deactivation may be associated with the time 92 of the deactivation input 110 and the input device 28 and/or associated with the location 200 and the input device 28. The corresponding electrical loads 56 are deactivated, according to the sequence of deactivation (Block 514).

Exemplary embodiments may be physically embodied on or in a computer-readable storage medium. This computer-readable medium may include CD-ROM, DVD, tape, cassette, floppy disk, memory card, USB, and large-capacity disks. This computer-readable medium, or media, could be distributed to end-subscribers, licensees, and assignees. A computer program product comprises processor-executable instructions for controlling electrical loads, as the above paragraphs explained.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A method for controlling a lighting environment, comprising:

receiving, at a controller, a message sent via a communications network from an input device, the message specifying a time associated with an input to the input device;

querying, by the controller, an electronic database for the time specified by the message, the electronic database electronically associating network addresses identifying light fixtures to time values including the time specified by the message;

identifying, by the controller, the time values in the electronic database that are less than the time specified by the message;

identifying, by the controller, the network addresses in the electronic database that are electronically associated with the time values less than the time specified by the message; and sending, by the controller, activation messages via the communications network to the network addresses identified in the relational table, the activation messages instructing the light fixtures to illuminate according to the time values less than the time specified by the message.

2. The method of claim 1, further comprising causing a display of the time values.

3. The method of claim 1, further comprising incrementing a timer.

4. The method of claim 1, further comprising determining a final time associated with the input.

5. The method of claim 1, further comprising determining a cessation of the input.

6. The method of claim 5, further comprising determining a final value of a timer at the cessation of the input.

7. The method of claim 1, further comprising sequentially activating the light fixtures.

8. A system for controlling a lighting environment, comprising:

a hardware processor; and a memory device, the memory device storing instructions, the instructions when executed causing the hardware processor to perform operations, the operations comprising:

receiving a message sent via a communications network from an input device, the message specifying a final value of a timer that times an input to the input device;

querying an electronic database for the final value of the timer specified by the message, the electronic database electronically represented as a relational table that associates network addresses identifying light fixtures to time values of the timer;

identifying the time values in the relational table that are less than the final value of the timer specified by the message;

identifying the network addresses in the relational table that are electronically associated with the time values less than the final value of the timer specified by the message; and sequentially sending activation messages via the communications network to the network addresses that are electronically associated with the time values less than the final value of the timer specified by the message, each activation message of the activation messages instructing a corresponding one of the light fixtures to illuminate.

9. The system of claim 8, wherein the operations further comprise causing a display of the final value of the timer.

10. The system of claim 8, wherein the operations further comprise stopping the timer.

11. The system of claim 8, wherein the operations further comprise deactivating the light fixtures.

12. The system of claim 8, wherein the operations further comprise activating a switch.

13. A method for controlling a lighting environment, comprising:

receiving, at a controller, a message sent via a communications network from a mobile device, the message specifying a final value of a timer that times an input to the mobile device;

querying, by the controller, an electronic database for the final value of the timer specified by the message, the electronic database electronically represented as a relational table that associates network addresses identifying light fixtures to time values of the timer;

identifying, by the controller, the time values in the relational table that are less than the final value of the timer specified by the message;

identifying, by the controller, the network addresses in the relational table that are electronically associated with the time values that are less than the final value of the timer specified by the message; and sequentially sending, by the controller, activation messages via the communications network to the network addresses that are electronically associated with the time values that are less than the final value of the timer specified by the message, each activation message of the activation messages instructing a corresponding one of the light fixtures to illuminate.

14. The method of claim 13, further comprising stopping the timer.

15. The method of claim 13, further comprising displaying the final value of the timer.

16. The method of claim 13, further comprising deactivating the light fixtures.

17. The method of claim 13, further comprising displaying a current value of the timer.

18. The method of claim 13, further comprising wirelessly receiving the message sent via the communications network from the mobile device.

* * * * *